US010371454B2

(12) United States Patent
Masgrau

(10) Patent No.: US 10,371,454 B2
(45) Date of Patent: Aug. 6, 2019

(54) PLATE FOR HEAT EXCHANGER AND HEAT EXCHANGER

(71) Applicant: AIREC AB, Malmö (SE)

(72) Inventor: Marcello Masgrau, Copenhagen (DK)

(73) Assignee: ALFA LAVAL CORPORATE AB, Lund (SE)

( * ) Notice: Subject to any disclaimer, the term of this patent is extended or adjusted under 35 U.S.C. 154(b) by 325 days.

(21) Appl. No.: 15/025,603

(22) PCT Filed: Oct. 14, 2013

(86) PCT No.: PCT/SE2013/051202
§ 371 (c)(1),
(2) Date: Mar. 29, 2016

(87) PCT Pub. No.: WO2015/057115
PCT Pub. Date: Apr. 23, 2015

(65) Prior Publication Data

US 2016/0245591 A1 Aug. 25, 2016

(51) Int. Cl.
*F28D 9/00* (2006.01)
*F28F 3/04* (2006.01)
(Continued)

(52) U.S. Cl.
CPC ..... *F28D 9/0056* (2013.01); *F28D 9/005* (2013.01); *F28F 3/044* (2013.01); *F28F 3/046* (2013.01);
(Continued)

(58) Field of Classification Search
CPC ..... F28D 9/005; F28D 9/0056; F28F 13/12; F28F 3/044; F28F 3/042; F28F 3/10
See application file for complete search history.

(56) References Cited

U.S. PATENT DOCUMENTS 3,946,804 A 3/1976 Tkach et al.
5,462,113 A 10/1995 Wand
(Continued)

FOREIGN PATENT DOCUMENTS

DE 530420 12/1940
DE 2706090 8/1977
(Continued)

*Primary Examiner* — Frantz F Jules
*Assistant Examiner* — Lionel Nouketcha
(74) *Attorney, Agent, or Firm* — Tarolli, Sundheim, Covell & Tummino LLP

(57) ABSTRACT

A plate (1) for a heat exchanger for heat exchange between a first and a second medium is configured with inlet and outlet portholes (2*a* and 2*b*) for the first medium and inlet and outlet portholes (3*a* and 3*b*) for the second medium and with a first heat transferring surface (A) for the first medium and a second heat transferring surface (B) for the second medium. The first heat transferring surface (A) is configured with at least one barrier (5) which forms part of a guide for the flow of the first medium when said first medium passes between the portholes (2*a*, 2*b*) therefor, and the plate (1) is configured with the portholes (2*a*, 2*b* and 3*a*, 3*b*) for the first and second medium respectively, and with the barrier located so relative to each other on the first heat transferring surface that they permit formation of a U-shaped or sinusoidal through-flow duct for the first medium which will permit passage of the flow thereof around the inlet porthole (3*a*) or both portholes (3*a*, 3*b*) for the second medium during passage of said first medium between the portholes therefor. A heat exchanger comprises a stack of the above-mentioned plates. An air cooler comprises the above-mentioned heat exchanger.

29 Claims, 12 Drawing Sheets

(51) Int. Cl.

| | |
|---|---|
| ***F28F 3/08*** | (2006.01) |
| ***F28F 13/12*** | (2006.01) |
| *F28F 3/10* | (2006.01) |
| *F28D 21/00* | (2006.01) |

(52) U.S. Cl.
CPC ..... *F28F 3/086* (2013.01); *F28F 13/12* (2013.01); *F28D 2021/0063* (2013.01); *F28F 3/042* (2013.01); *F28F 3/10* (2013.01); *F28F 2225/04* (2013.01)

(56) References Cited

U.S. PATENT DOCUMENTS

| | | | | |
|---|---|---|---|---|
| 2006/0048927 | A1 | 3/2006 | Blomgren | |
| 2007/0089871 | A1* | 4/2007 | Andersson | F28D 9/005 165/167 |
| 2008/0223564 | A1 | 9/2008 | Bjornsson et al. | |
| 2009/0151917 | A1 | 6/2009 | Meschke et al. | |
| 2009/0194267 | A1* | 8/2009 | Gustafsson | F28D 9/005 165/168 |
| 2010/0025026 | A1* | 2/2010 | Dietz | F28D 9/0068 165/166 |
| 2010/0116479 | A1* | 5/2010 | Persson | F28D 1/0341 165/166 |
| 2011/0088882 | A1 | 4/2011 | Persson | |
| 2012/0103579 | A1* | 5/2012 | Reif | F28D 9/005 165/167 |
| 2012/0118548 | A1* | 5/2012 | Han | F28D 1/0333 165/177 |

FOREIGN PATENT DOCUMENTS

| | | | | |
|---|---|---|---|---|
| DE | 2706090 | A1 * | 8/1977 | F28D 9/0075 |
| DE | 19547185 | | 6/1997 | |
| DE | 19716845 | | 10/1998 | |
| DE | 2169338 | A1 * | 3/2010 | F02B 29/0462 |
| JP | 201054187 | | 3/2010 | |
| JP | 2013130300 | | 7/2013 | |
| JP | 2013130300 | A * | 7/2013 | |
| TW | 201013151 | A1 * | 4/2010 | F28D 9/005 |
| WO | 03006911 | | 1/2003 | |
| WO | 03010482 | | 2/2003 | |
| WO | 2007142590 | | 12/2007 | |
| WO | 2009151399 | | 12/2009 | |

* cited by examiner 1
1b
A
12a
15b
15ba
14a
13
4
1c
3b
3ba
6
5
10
2a
9
1a
4
11a
7a 1
1b
B
12
5a
12
11
10a
7
4
1a
12
9a
2a
2aa
13a
14
3b
9a
1c
4
15b

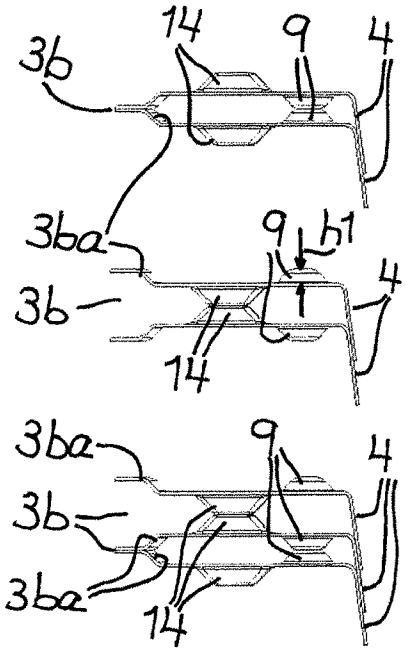
4
9
14
3b
h1
3ba
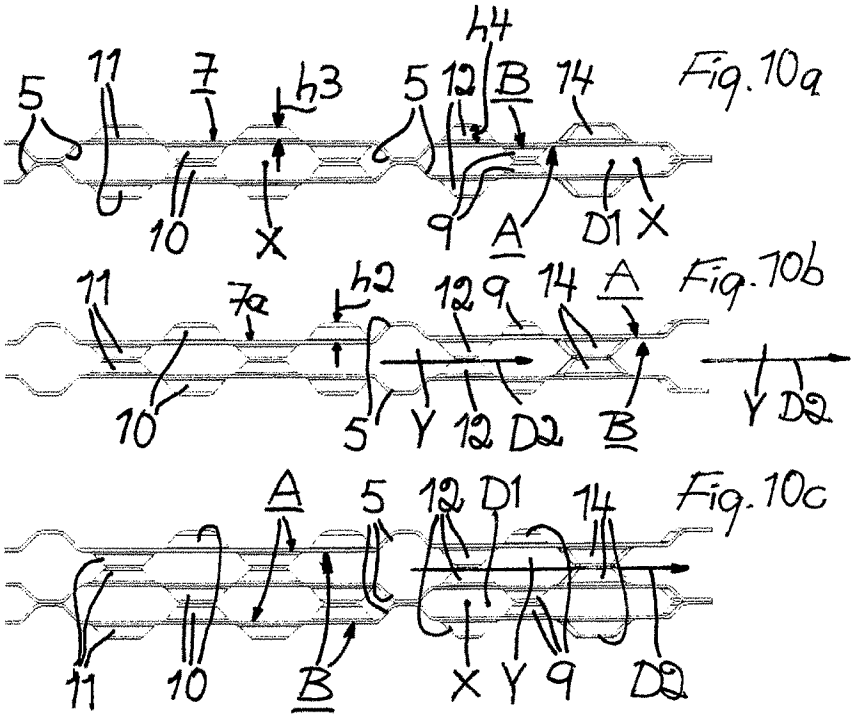
Fig. 10a
Fig. 10b
Fig. 10c
44
B
A
14
12
5
9
h3
7
11
10
X
D1
h2
7a
Y
D2

PLATE FOR HEAT EXCHANGER AND HEAT EXCHANGER

RELATED APPLICATIONS

This application corresponds to PCT/SE2013/051202, filed Oct. 14, 2013, the subject matter, of which is incorporated herein by reference in its entirety.

TECHNICAL FIELD

The present invention relates to a plate for a heat exchanger for heat exchange between a first and a second medium. The plate is configured with inlet and outlet portholes for the first medium and inlet and outlet portholes for the second medium. The plate is further configured with a first heat transferring surface for the first medium and an opposing second heat transferring surface for the second medium.

The present invention also relates to a heat exchanger for heat exchange between a first and a second medium. The heat exchanger comprises a stack of the above-mentioned plates.

Finally, the present invention relates to an air cooler, comprising the above-mentioned heat exchanger which in turn comprises a stack of the above-mentioned plates.

BACKGROUND OF THE INVENTION

Heat exchangers are used in many different areas, e.g. in the food processing industry, in buildings for use in heating and cooling systems, in gas turbines, boilers and many more. Attempts to improve the heat exchanging capacity of a heat exchanger is always interesting and even small improvements are highly appreciated.

SUMMARY OF THE INVENTION

An object of the present invention is to provide a plate for a heat exchanger and a heat exchanger for improved guidance of the media for heat exchange in order to thereby improve cooling of one of said media and thus, the heat exchanging capacity.

The above and further objects are achieved by means of a plate wherein the first heat transferring surface of the plate is configured with at least one barrier which forms part of a guide for the flow of the first medium when said first medium passes between the inlet and outlet portholes therefor, and wherein the plate is configured with the inlet and outlet portholes for the first and second medium respectively, and with the barrier forming part of a guide for the flow of the first medium located so relative to each other on the first heat transferring surface of the plate that they permit formation of a substantially U-shaped or sinusoidal through-flow duct for the first medium which will permit passage of the flow of said first medium around said inlet porthole or said inlet and outlet portholes for the second medium during passage of said first medium between said inlet and outlet portholes therefor.

Thus, on condition that the first medium is the cooling medium and the second medium is the medium to be cooled, the plate is configured to enable the first medium to improve cooling of and heat exchange with the second medium directly at the inlet porthole for said second medium. By means of the at least one barrier forming a guide for the flow of the first medium, the plate is further configured to enable the first medium to be in prolonged contact with the second medium for cooling thereof. Finally, the plate may be configured to enable the first medium to cool the second medium also at the outlet porthole for said second medium. By configuring the plate such that the portholes for the second medium are located in the middle of the flow of the first medium that can be controlled by the location of the at least one barrier forming part of a guide for said first medium, optimum cooling of the second medium for reducing thermal tensions in the plate is achieved. It will then be possible to use the plate in heat exchangers for hot gases.

By configuring the plate with dimples around the inlet and outlet portholes for the second medium on the first heat transferring surface of the plate located at a larger distance from each other on those parts of the circumferences of the portholes which face each other, and which face away from the inlet and outlet portholes for the first medium, than on those parts of the circumference of said portholes which face away from each other, the first medium will, particularly in a heat exchanger of counter-flow type, be able to further improve cooling of the second medium at the portholes for the second medium. This is achieved because the flow of the first medium thanks to the dimples will experience a greater resistance at those parts of the circumference of the outlet porthole for the second medium which are facing the inlet porthole for the first medium, and a larger part of the first medium than otherwise will thereby be forced to flow further around said porthole for the second medium for cooling thereof and for cooling the second medium flowing through said porthole. At the inlet porthole for the second medium, the flow of the first medium will experience a less resistance and a larger part thereof than otherwise will therefore reach the circumference of said inlet porthole for the second medium much quicker for cooling thereof and for cooling the second medium flowing through said porthole before said first medium reaches its outlet porthole.

Optimum guiding of the second medium for cooling thereof will also be the result of that the plate is configured with dimples around the inlet and outlet portholes for the second medium on the second heat transferring surface of the plate located at a larger distance from each other on those parts of the circumferences of the portholes which face away from each other, and which at least partly face the inlet and outlet portholes for the first medium, than on those parts of said circumferences which face each other. The flow of the second medium will thanks to the dimples experience a greater resistance at those parts of the circumferences of the portholes which are facing each other, thereby forcing a larger part of the flow of the second medium from the inlet porthole therefor to initially flow in a direction away from the outlet porthole therefor and spread over the second heat transferring surface for exposure to the first medium for cooling.

Optimum guiding of the second medium for cooling thereof is also achieved by configuring the second heat transferring surface of the plate with at least one elevated portion which forms a part of a restriction for the flow of the second medium during passage thereof between the inlet and outlet portholes therefor. By locating the elevated portion in a central part of the second heat transferring surface of the plate to enable restriction and deflection of at least a part of the flow of the second medium when said flow of the second medium reaches said elevated portion during passage thereof between the inlet and outlet portholes therefor, a substantial part of the flow of the second medium can be brought to flow to the sides of the second heat transferring surface and thereby prolong the flow distance and thus, the time it takes for the second medium to flow along the second heat transferring surface between the inlet and outlet portholes therefor.

The above and other objects are achieved also by means of a heat exchanger wherein the plates are stacked such that the first heat transferring surfaces for the first medium of two adjacent plates face each other and the second heat transferring surfaces for the second medium of two adjacent plates face each other, thereby defining, by means of the at least one barrier on the first heat transferring surfaces of two adjacent plates, a substantially U-shaped or sinusoidal through-flow duct for the first medium between said first heat transferring surfaces therefor as well as a through-flow duct for the second medium between the second heat transferring surfaces therefor, and such that a peripheral flange on one of two adjacent plates, the first or second heat transferring surfaces of which face each other, surrounds the through-flow duct defined between said heat transferring surfaces.

As defined, a heat exchanger is provided, the heat-exchanging capacity of which is improved by optimum guiding of the first and second media for optimum cooling of the second medium.

As defined, the heat exchanger may be used to provide e.g. an improved air cooler, i.e. one medium is air and the other a liquid.

BRIEF DESCRIPTION OF THE DRAWINGS

The present invention will be further described below with reference to the accompanying drawings, in which

FIGS. 10*a*-10*c* are schematic sectional views similar to FIG. 9*b* and illustrate parts of two or three plates according to the present invention when put together;

DETAILED DESCRIPTION OF PREFERRED EMBODIMENTS

Figure 1:
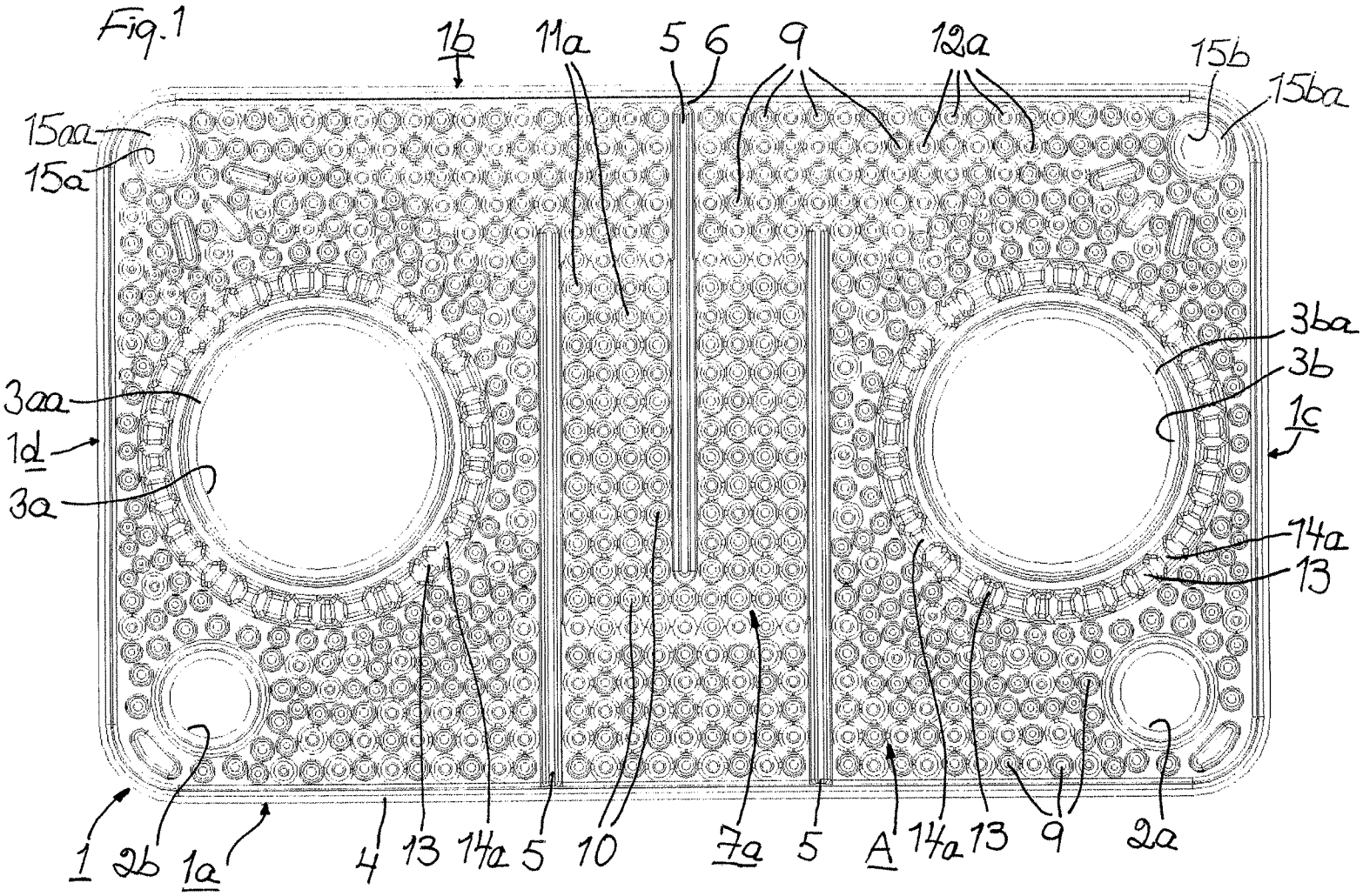
FIG. 1 is a plan view of a first embodiment of a plate according to the present invention.
Figure 2:
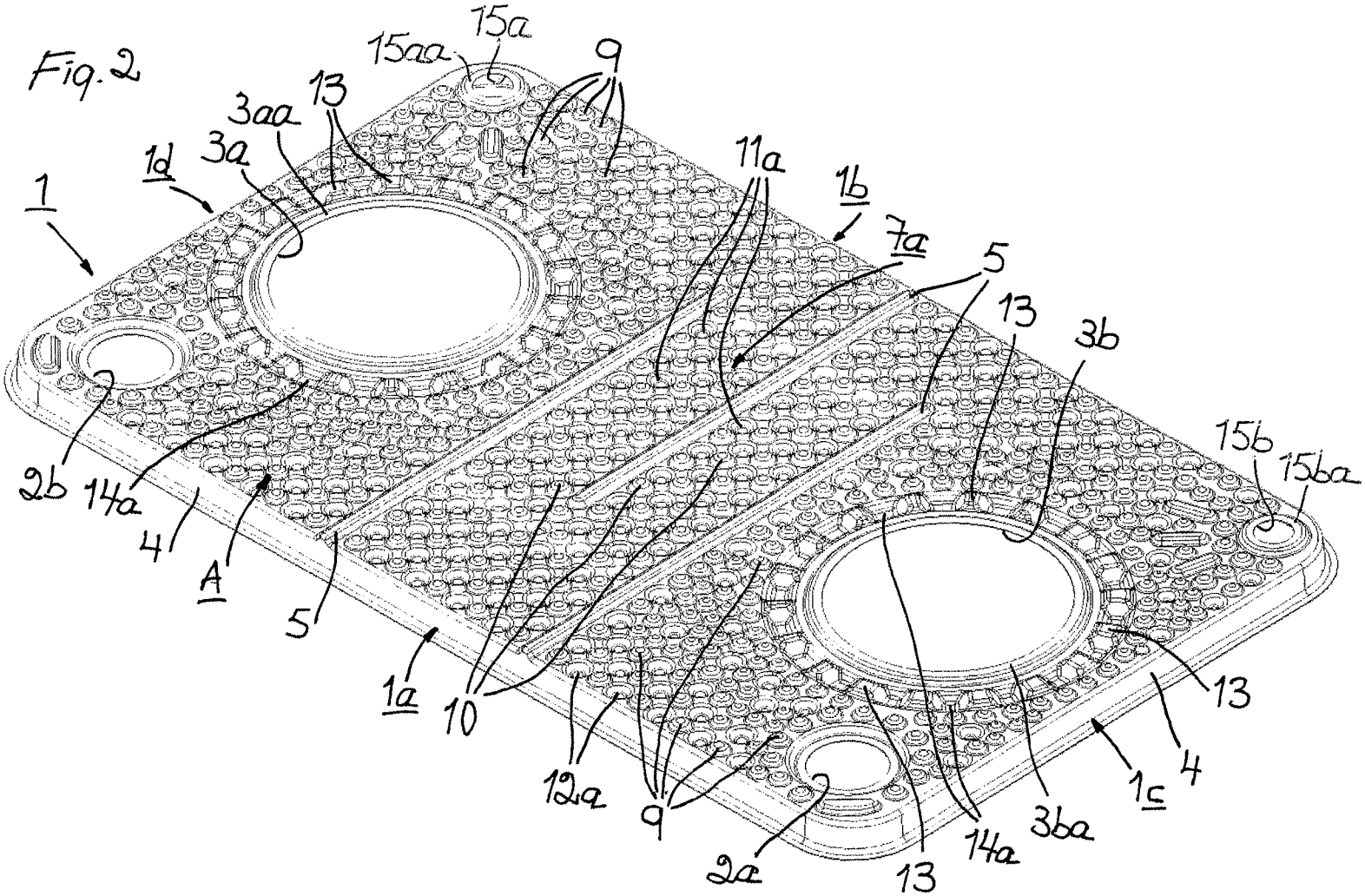
FIG. 2 is a perspective view of the first embodiment of the plate according to the present invention.
Figure 3:
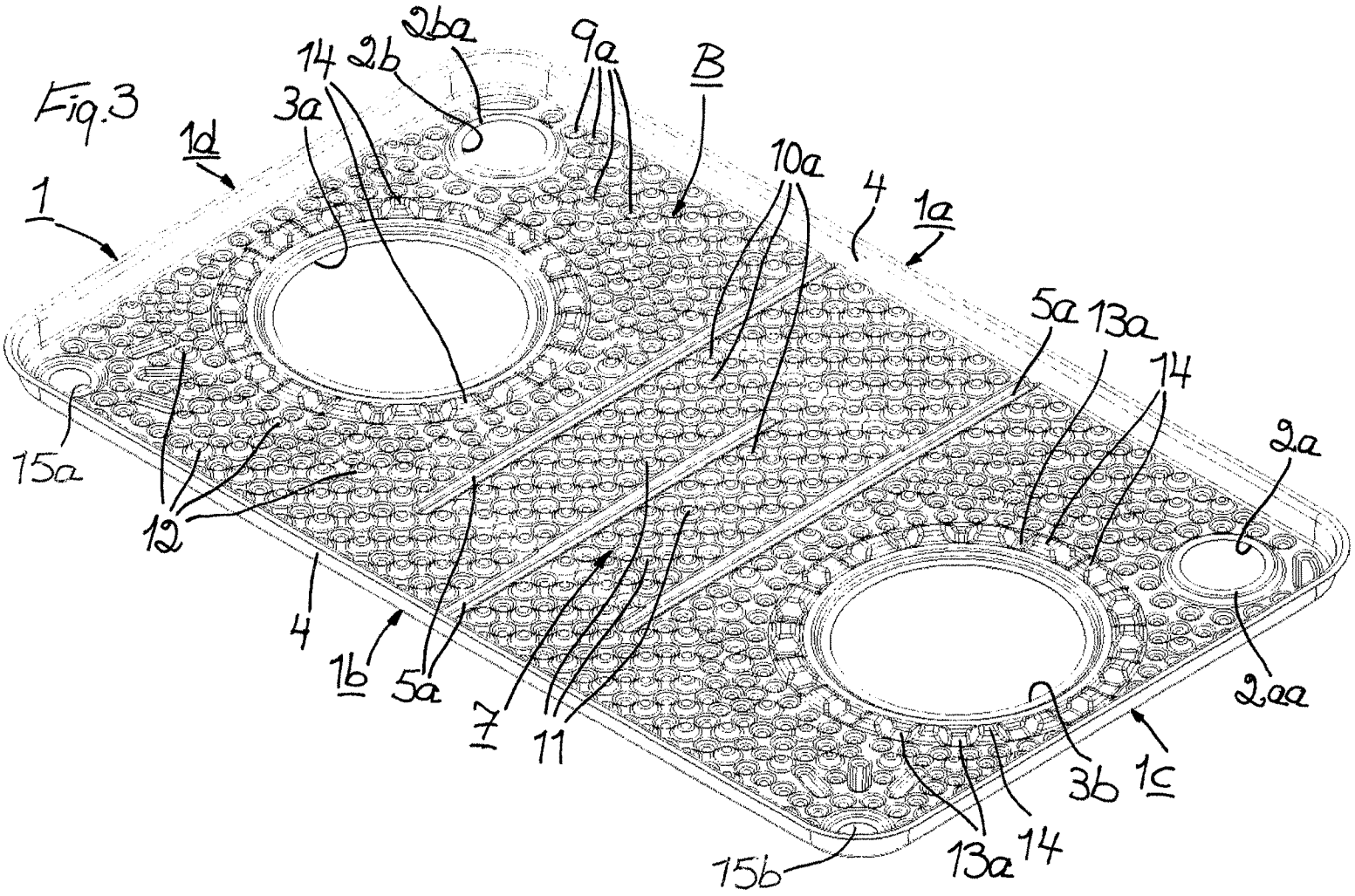
FIG. 3 is a perspective view from the opposite side of the first embodiment of the plate according to the present invention.
Figure 4:
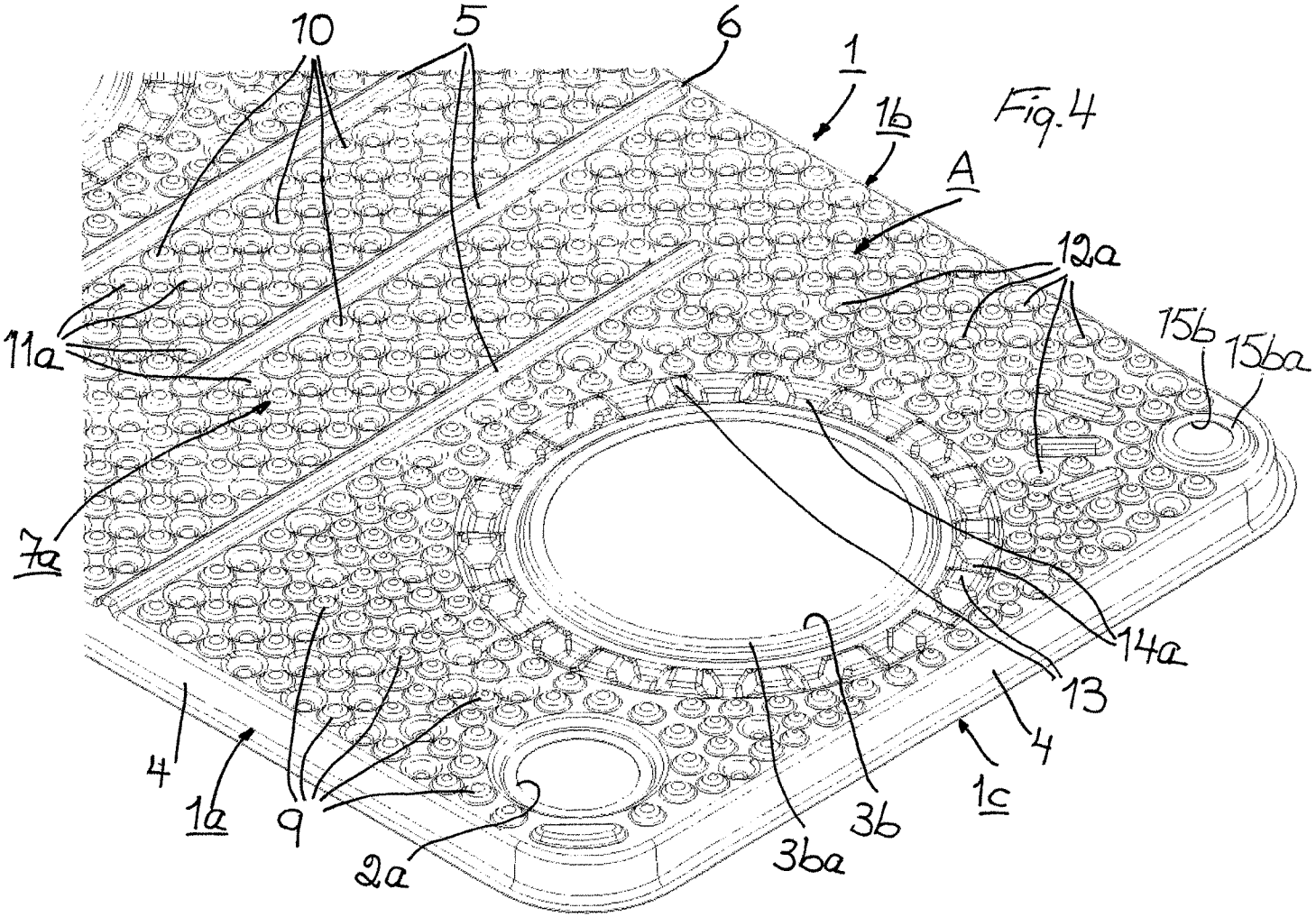
FIG. 4 is an enlarged perspective view of a part of the plate according to FIG. 2.

As already stated, the present invention relates to a plate for a heat exchanger for heat exchange between a first and a second medium. The plate 1 may have any desired shape for its intended purpose. It may be rectangular with two opposing long sides 1*a* and 1*b* and two opposing short sides 1*c* and 1*d* as illustrated in the drawings. The plate 1 may alternatively have a square shape, with four equally long sides, or any other suitable quadrilateral, triangular, multi-sided, round, rhombic, elliptic or other shape for the intended application and use. A plurality of plates 1 may be assembled to form a stack which is then used in a heat exchanger according to the present invention.

The first and second medium referred to for heat exchange may be the same, e.g. gas/gas (such as air) or liquid/liquid (such as water). The first and second medium referred to may also be two different media, e.g. gas/liquid or two different gases or liquids.

As illustrated in FIGS. 1-8 and 9*a*, the plate 1 according to the present invention is configured with at least one inlet porthole 2*a* and at least one outlet porthole 2*b* for the first medium and at least one inlet porthole 3*a* and at least one outlet porthole 3*b* for the second medium. The inlet and outlet portholes 2*a*, 2*b*, 3*a*, 3*b* for the first and second media are as illustrated in FIGS. 1-8 and 9*a* round, but may of course have any other suitable shape for the intended application and use. The diameters of the inlet and outlet portholes 3*a*, 3*b* for the second medium are the same and much larger than the substantially identical diameters of the inlet and outlet portholes 2*a*, 2*b* for the first medium. As illustrated in FIGS. 1-8 and 9*a*, according to which the plate 1 is rectangular, the inlet and outlet portholes 2*a*, 2*b* for the first medium are located at opposite ends of the plate, e.g. at the two opposing short sides 1*c*, 1*d* of the plate. The inlet and outlet portholes 3*a*, 3*b* for the second medium are also located at the opposite ends of the plate 1, adjacent or close to the inlet and outlet portholes 2*a*, 2*b* for the first medium. Accordingly, when the first and second media flows between their respective inlet and outlet portholes, their flow direction will, generally seen, be in the longitudinal direction of the plate 1, thereby increasing the dwell time of the media in their respective through-flow ducts X and Y, defined between a stack of plates in a heat exchanger and thus, improving the heat exchanging capacity of the heat exchanger. If the heat exchanger comprising a number of such plates 1 is of a counterflow type, the inlet porthole 3*a* for the second medium is then located close to the outlet porthole 2*b* for the first medium and the outlet porthole 3*b* for the second medium close to the inlet porthole 2*a* for the first medium. If on the other hand the heat exchanger is of a parallel-flow type, then the inlet porthole 3*a* for the second medium is located close to the inlet porthole 2*a* for the first medium and the outlet porthole 3*b* for the second medium close to the outlet porthole 2*b* for the first medium. The plate 1 according to FIGS. 1-8 is configured for use in a heat exchanger of counter-flow type.

As illustrated in FIGS. 1, 2, 4 and 7, the plate 1 according to the present invention also has a first heat transferring surface A for the first medium and, as illustrated in FIGS. 3, 5, 6, 8 and 9*a*, an opposing second heat transferring surface B for the second medium on the opposite side of the plate. The inlet and outlet portholes 2*a*, 2*b* for the first medium are on the second heat transferring surface B configured with a peripheral edge 2*aa* and 2*ba* respectively, and the inlet and outlet portholes 3*a*, 3*b* for the second medium are on the first heat transferring surface A configured with a peripheral edge 3*aa* and 3*ba* respectively. When plates 1 are stacked, they are stacked such that the first heat transferring surfaces A for the first medium of two adjacent plates face each other (see FIGS. 10*a* and 10*c*). Then, the peripheral edges 3*aa*, 3*ba* of the inlet and outlet portholes 3*a*, 3*b* for the second medium will engage each other and prevent said second medium from penetrating into the through-flow duct X defined between the two first heat transferring surfaces A for the first medium which face each other. Correspondingly, when plates 1 are stacked, they are stacked such that the second heat transferring surfaces B for the second medium of two adjacent plates face each other (see FIGS. 10*b* and 10*c*). Then, the peripheral edges 2*aa*, 2*ba* of the inlet and outlet portholes 2*a*, 2*b* for the first medium will engage each other and prevent said first medium from penetrating into the through-flow duct Y defined between the two second heat transferring surfaces B for the second medium which face each other.

The plate 1 according to the present invention may be configured with a peripheral flange 4 which protrudes from the plate such that it surrounds either or both of the first heat transferring surface A for the first medium and the second heat transferring surface B for the second medium. At the embodiment illustrated in FIGS. 1-4, the flange 4 protrudes from the plate 1 such that it surrounds the second heat transferring surface B for the second medium and at the embodiment of FIGS. 5-8 and 9*a*, the flange 4 protrudes from the plate such that it surrounds the first heat transferring surface A for the first medium. In all other aspects, the embodiment of the plate 1 illustrated in FIGS. 5-8 and 9*a* is identical with the embodiment of the plate 1 illustrated in FIGS. 1-4.

The first heat transferring surface A of the plate 1 according to the present invention is also configured with at least one barrier 5 which forms a part of a guide for the flow of the first medium when said first medium passes between the inlet and outlet portholes 2*a*, 2*b* therefor, i.e. a guide located in the through-flow duct X for the first medium. Each barrier 5 may on the opposite second heat transferring surface B of the plate 1 define a corresponding recess 5*a*.

According to the present invention, the plate 1 is configured with the inlet and outlet portholes 2*a*, 2*b* and 3*a*, 3*b* for the first and second medium respectively, and with the barrier 5 forming part of a guide for the flow of said first medium located relative to each other such that they permit, if a plurality of plates should be assembled to form a stack thereof, formation of a substantially U-shaped or sinusoidal through-flow duct X for the first medium which will permit passage of the flow of said first medium around said inlet porthole 3*a* or around said inlet and outlet portholes 3*a*, 3*b* for said second medium during passage of said first medium between the inlet and outlet portholes 2*a*, 2*b* therefor. Accordingly, the plate 1 is configured with the barrier 5 forming part of a guide for the flow of the first medium located between the inlet and outlet portholes 2*a*, 2*b* and 3*a*, 3*b* for the first and second medium respectively, i.e. between the opposite ends of the plate where said portholes are located, with one porthole 2*a*, 3*b* for the respective medium on one side of the barrier and the other porthole 2*b*, 3*a* for the respective medium on the other side of the barrier.

As stated above, the plate 1 is thereby configured to enable the first medium, the cooling medium, to improve cooling of and heat exchange with the second medium, the medium to be cooled, directly at the inlet porthole 3*a* for said second medium, and by means of the at least one barrier 5 forming a guide for the flow of the first medium, the plate is further configured to enable the first medium to be in prolonged contact with the second medium for cooling thereof. Finally, the configuration of the plate may enable the first medium to cool the second medium also at the outlet porthole 3*b* for said second medium. By configuring the plate 1 such that the inlet porthole 3*a* or both portholes 3*a*, 3*b* for the second medium are located in the middle of the flow of the first medium that can be controlled by the location of the at least one barrier 5 forming part of a guide for said first medium, optimum cooling of the second medium is achieved, rendering it possible to use the plate in heat exchangers for hot gases.

The plate 1 may be configured in many different ways in order to obtain the above-mentioned location of the inlet and outlet portholes 2*a*, 2*b* and 3*a*, 3*b* for the first and second medium respectively, and of the barrier 5, relative to each other to permit formation of a through-flow duct X for the first medium as defined and for guiding the flow of the first medium past the inlet porthole 3*a* or the inlet and outlet portholes 3*a*, 3*b* for the second medium as defined.

At the embodiments of the plate according to FIGS. 1-8 and 9*a*, with a rectangular plate 1 with two opposing long sides 1*a*, 1*b* and two opposing short sides 1*c*, 1*d*, the plate is configured with the inlet porthole 2*a* for the first medium located in or close to a corner between one of the two long sides 1*a* or 1*b*, here the long side 1*a*, and one of the two short sides 1*c* or 1*d*, here the short side 1*c*. The outlet porthole 2*b* for the first medium is located in or close to a corner between the same long side 1*a* and the other of said two short sides 1*d* or 1*c*, i.e. the short side 1*d*. The inlet porthole 3*a* for the second medium is located between the two long sides 1*a*, 1*b*, e.g. substantially centrally between the two long sides 1*a*, 1*b* as illustrated, and close to one of the two short sides 1*c* or 1*d*, here the short side 1*d* since the plate 1 is considered to be used in a heat exchanger of the crossflow/counter-flow type, and the outlet porthole 3*b* for the second medium is located between said two long sides, e.g. substantially centrally between said two long sides, and close to the other of said two short sides 1*d* or 1*c*, i.e. the short side 1*c*. Alternatively, in some embodiments where the plate 1 has a less width, the inlet and outlet portholes 3*a*, 3*b* for the second medium may be located closer to the long side opposing the long side closest to the inlet and outlet portholes 2*a*, 2*b* for the first medium, here the long side 1*b*, and thus, possibly in or close to the corner between said long side and the respective short side opposing the corner in or at which the inlet and outlet portholes respectively, for the first medium are located. The plate 1 is further configured with three barriers 5 which are provided on the first heat transferring surface A of the plate. The number of barriers however, may be any other uneven number, e.g. one, five, seven, nine etc. The two barriers 5 closest to the inlet and outlet portholes 2*a*, 2*b* for the first medium respectively, are configured to extend from the long side 1*a* closest to said portholes and towards the opposing long side 1*b* and the third barrier between said two barriers extends from said opposing long side 1*b* towards said long side 1*a* to form part of three guides for guiding the flow of said first medium along a substantially sinusoidal through-flow duct X. With only one barrier 5 provided on the first heat transferring surface A of the plate 1, said barrier will extend from the long side 1*a* closest to said portholes 2*a*, 2*b* and towards the opposing long side 1*b* to permit formation of a guide for guiding the first medium along a substantially U-shaped through-flow duct X. With five, seven, nine or any other uneven number of barriers 5, the barriers between the two barriers which are located closest to the inlet and outlet portholes 2*a*, 2*b* for the first medium are configured to extend alternately from one of the two long sides 1*a* or 1*b* and towards the opposing long side 1*b* or 1*a* and thereby permit formation of additional guides for guiding the first medium along a substantially sinusoidal through-flow duct X. If alternatively, the plate 1 described above is configured with an even number of barriers 5, then the barriers should be located such that at least the inlet porthole for the second medium and the second medium entering therethrough is cooled by the first medium.

Figure 5:
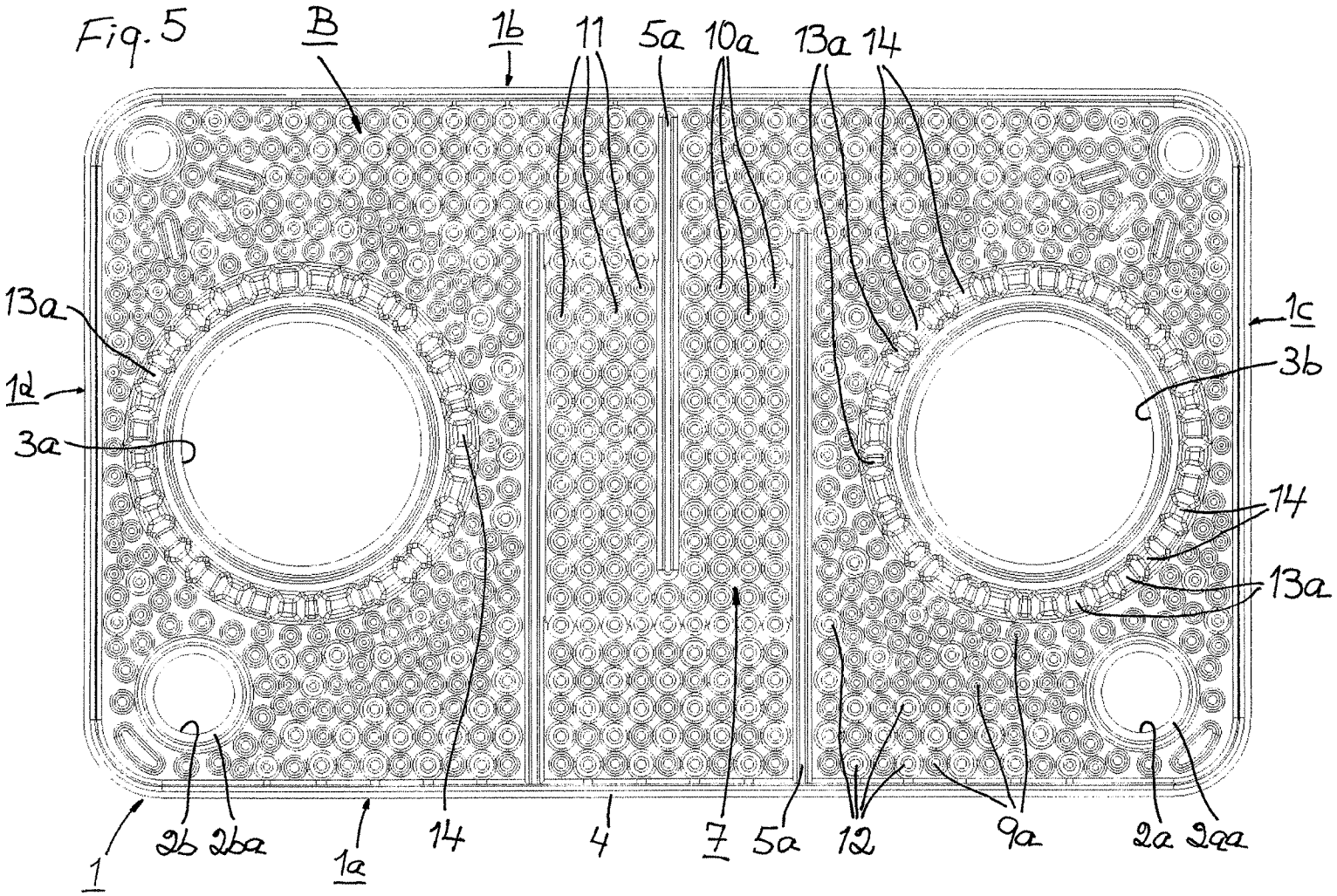
FIG. 5 is a plan view of a second embodiment of the plate according to the present invention.
Figure 6:
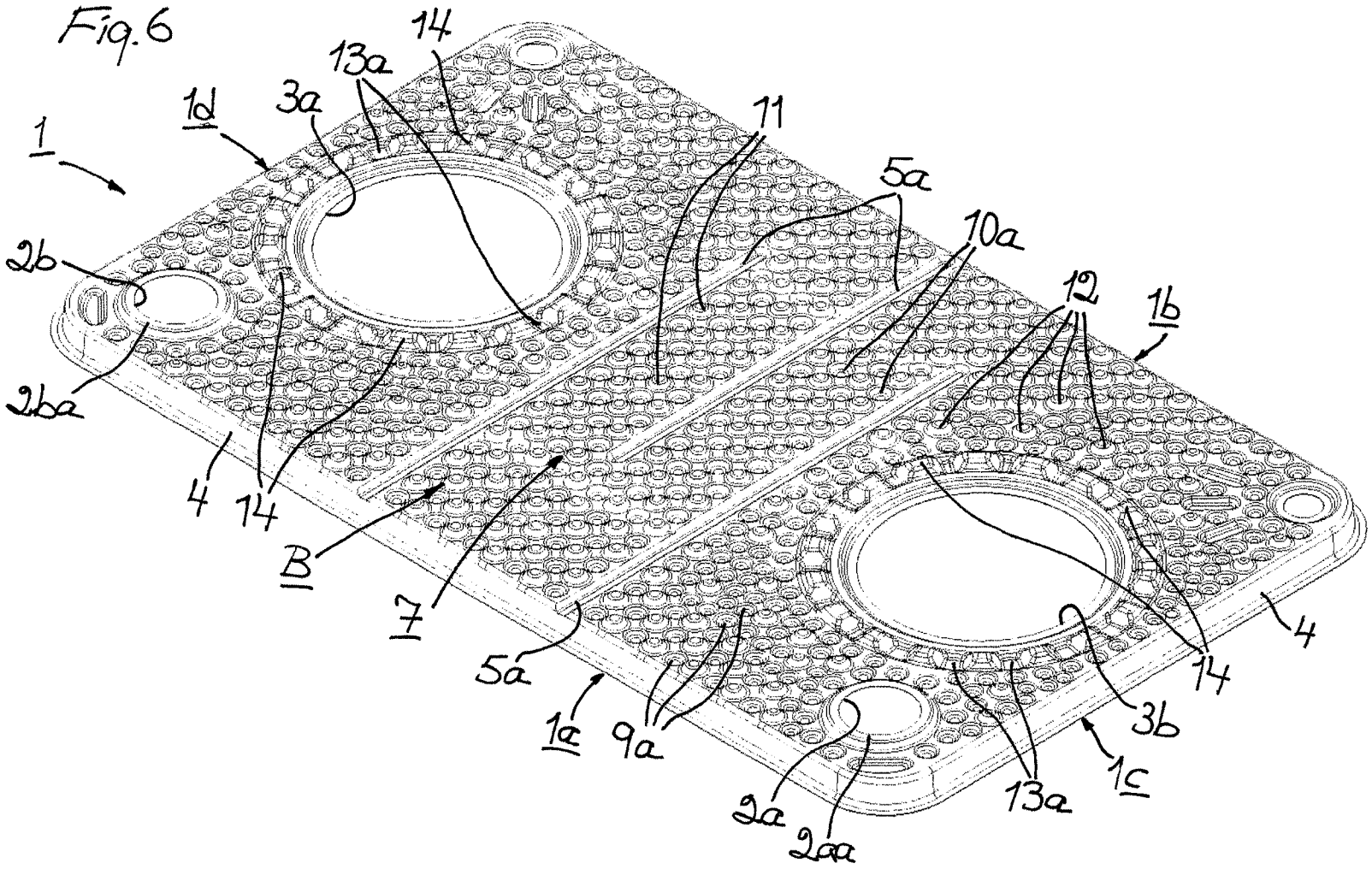
FIG. 6 is a perspective view of the second embodiment of the plate according to the present invention.
Figure 7:
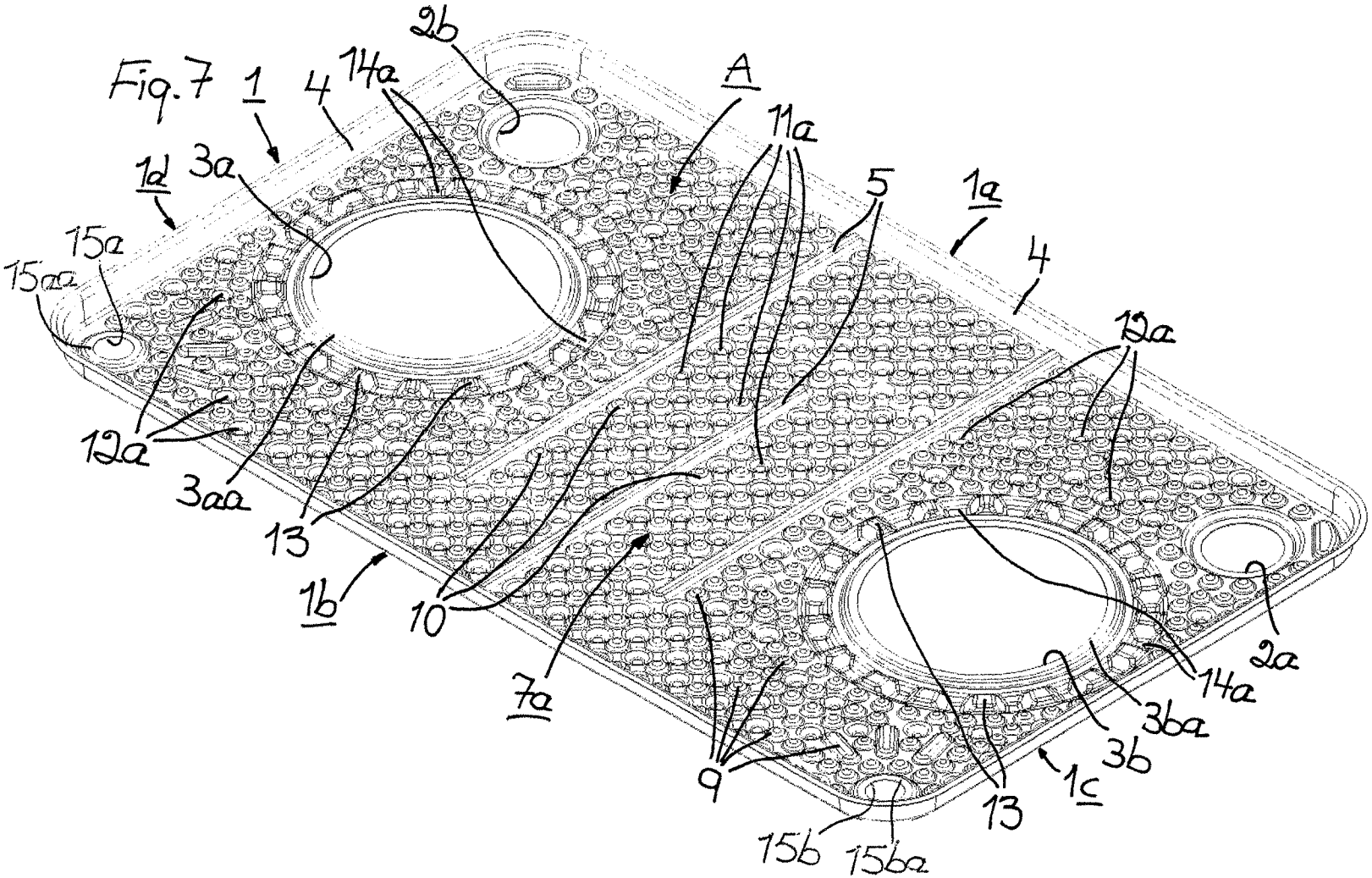
FIG. 7 is a perspective view from the opposite side of the second embodiment of the plate according to the present invention.
Figure 8:
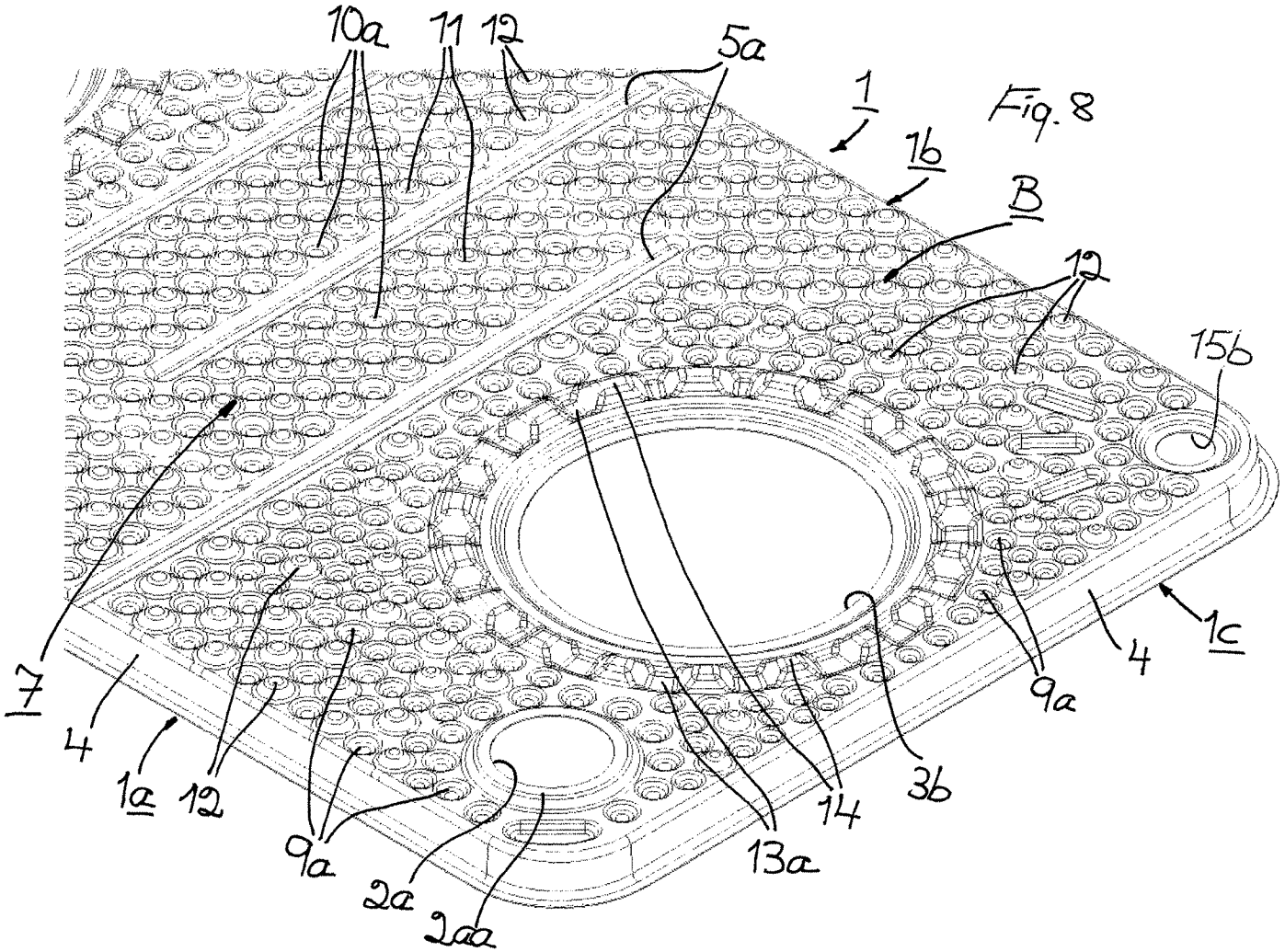
FIG. 8 is an enlarged perspective view of a part of the plate according to FIG. 6.
Figures 9A, 9B:
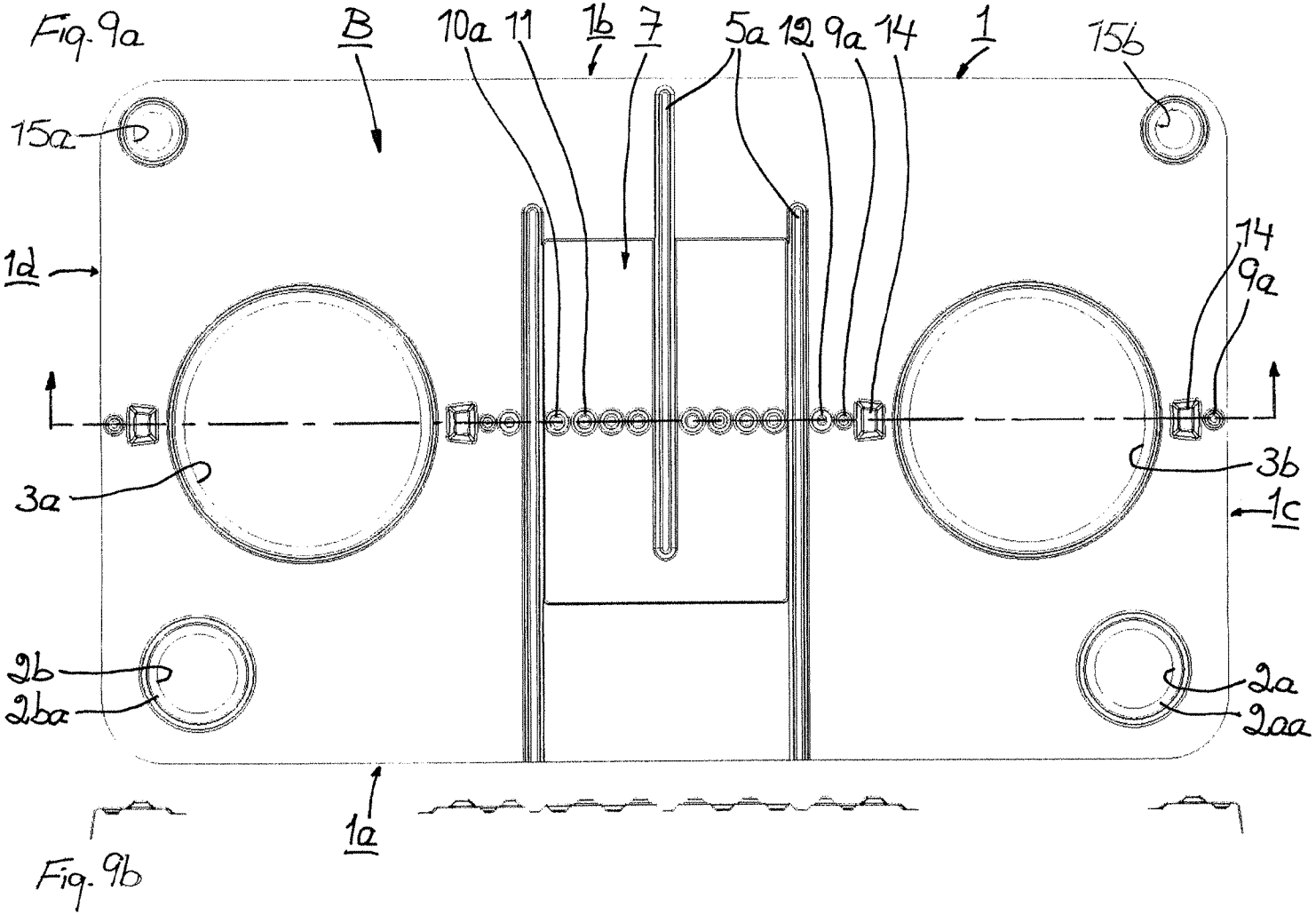
FIGS. 9*a* and 9*b* are a very schematic plan view similar to FIG. 5 of the second embodiment of the plate according to the present invention, but with most of the dimples removed for illustrative purposes, and a longitudinal sectional view centrally through the plate as illustrated in FIG. 9*a* respectively.
Figure 11:
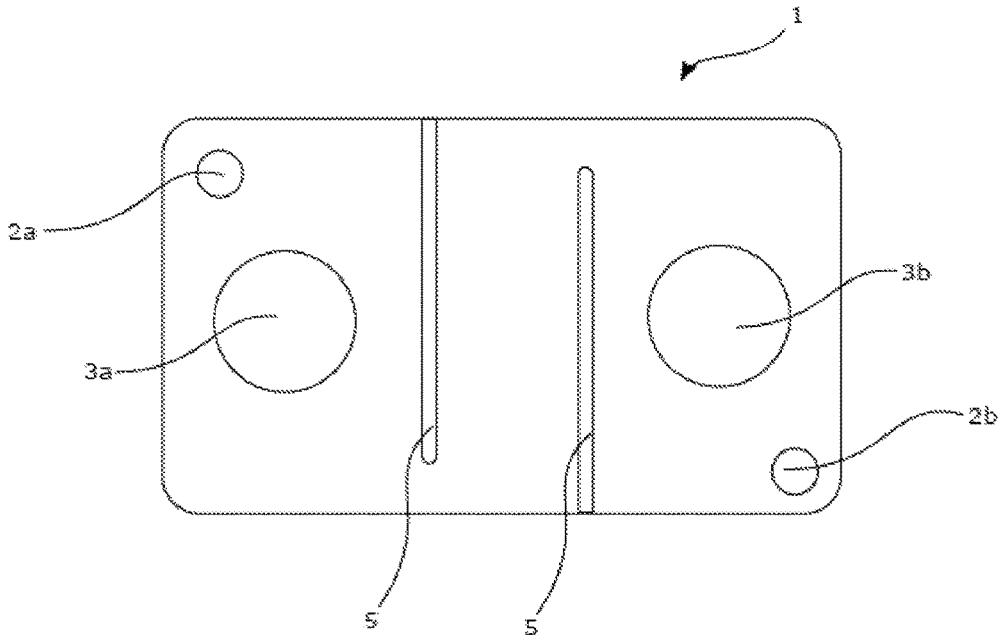
FIG. 11 is a plan view of another embodiment of the plate according to the present invention.
Figure 12:
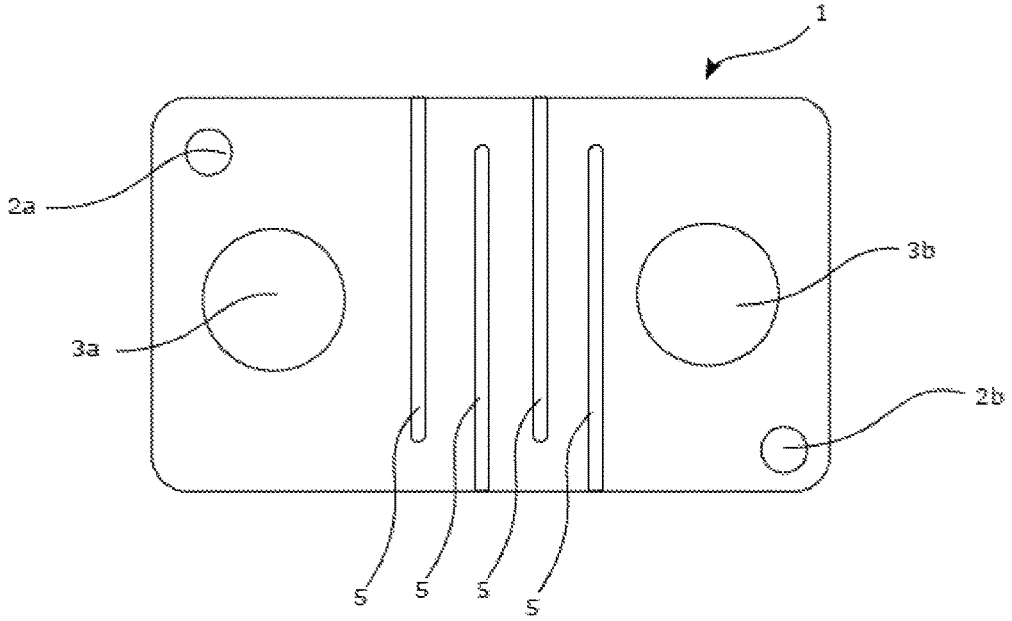
FIG. 12 is a plan view of another embodiment of the plate according to the present invention.
Figure 13:
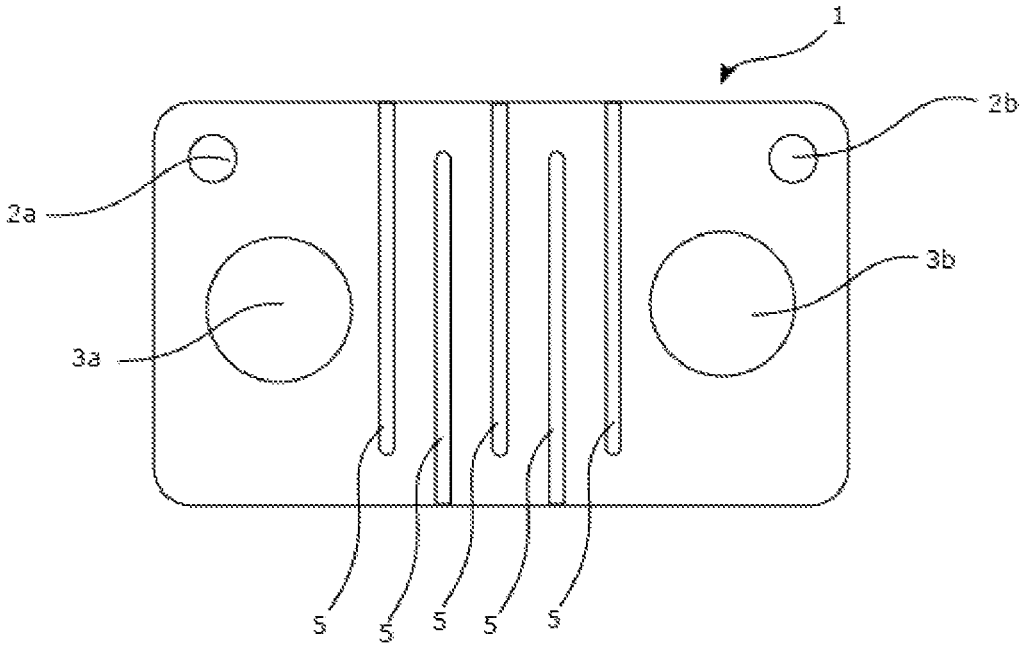
FIG. 13 is a plan view of another embodiment of the plate according to the present invention.

In an alternative embodiment, the plate 1 is configured with the inlet porthole 2*a* for the first medium still located in or close to a corner between one of the two long sides 1*a* or 1*b*, e.g. the long side 1*a*, and one of the two short sides 1*c* or 1*d*, e.g. the short side 1*c*. The outlet porthole 2*b* for the first medium however, is located in or close to a corner between the other of said two long sides 1*b* or 1*a*, i.e. the long side 1*b*, and the other of said two short sides 1*d* or 1*c*, i.e. the short side 1*d*. This is schematically illustrated in FIGS. 1 and 5 with broken lines. The inlet porthole 3*a* for the second medium is, as in FIGS. 1-8 and 9*a*, located between the two long sides 1*a*, 1*b*, e.g. substantially centrally between the two long sides 1*a*, 1*b*, and close to one of the two short sides 1*c* or 1*d*, e.g. the short side 1*d* since here again the plate 1 is considered to be used in a heat exchanger of the cross-flow/counter-flow type, and the outlet porthole 3*b* for the second medium is located between said two long sides, e.g. substantially centrally between said two long sides, and close to the other of said two short sides 1*d* or 1*c*, i.e. the short side 1*c*. Here too, as described above, the inlet and outlet portholes 3*a*, 3*b* for the second medium may be located closer to the long side opposing the long side closest to the inlet and outlet portholes 2*a*, 2*b* for the first medium and thus, possibly in or close to the corner between said long side and the respective short side opposing the corner in or at which the inlet and outlet portholes respectively, for the first medium are located. Contrary to the embodiments of FIGS. 1-8 and 9*a*, the plate 1 is here, because of the location of the outlet porthole 2*b* for the first medium, configured with an even number of barriers 5 on the first heat transferring surface A of the plate, i.e. two, four, six eight or more barriers. The two barriers 5 closest to the inlet and outlet portholes 2*a*, 2*b* for the first medium respectively, are configured to extend from the long side 1*a* or 1*b* closest to the respective porthole 2*a* or 2*b* and towards the opposing long side 1*b* or 1*a* to form part of two guides for guiding the flow of said first medium along a substantially sinusoidal through-flow duct X. With four, six, eight or any other even number of barriers 5, the barriers between the two barriers which are located closest to the inlet and outlet portholes 2*a*, 2*b* for the first medium are configured to extend alternately from one of the two long sides 1*a* or 1*b* and towards the opposing long side 1*b* or 1*a* and thereby permit formation of additional guides for guiding the first medium along a substantially sinusoidal through-flow duct X. If alternatively, the above-mentioned plate 1 is configured with an uneven number of barriers 5, as in FIGS. 1-8 and 9*a*, then the barriers should be located such that at least the inlet porthole for the second medium and the second medium entering therethrough is cooled by the first medium.

Thus, by configuring the plate 1 with any number of additional barriers 5, the through-flow duct X for the first medium which will be defined by the guides which are formed by the barriers when the first heat transferring surfaces A for the first medium of two adjacent plates are brought together, facing each other, will be extended to prolong the time for heat exchange between the first and second media for improving the heat exchanging capacity.

Each barrier 5 between the barriers closest to the inlet and outlet portholes 2*a*, 2*b* for the first medium is/are preferably configured separated a small distance 6 from the respective long side 1*a* or 1*b* from which it extends. This is done in order to permit leakage of a part of the flow of the first medium through said distance or, rather, through the space defined by two of said distances which face each other when the first heat transferring surfaces A for the first medium of two adjacent plates are brought together. By means of this configuration of the plate 1, it is possible to deflect a small amount of the first medium to increase the flow thereof along parts of the long sides 1*a*, 1*b* of the plate.

Although the angle may vary, each barrier 5 preferably extends from the respective long side 1*a*, 1*b* substantially perpendicular thereto.

Alternatively, it is of course also possible to configure the plate 1 with the inlet and outlet portholes 2*a*, 2*b*, 3*a*, 3*b* for the first and second media arranged such that the barrier or barriers 5 extend from one or both short sides 1*c*, 1*d* of the plate in order to form parts of one or more guides by means of which formation of a substantially U-shaped or sinusoidal through-flow duct X for the first medium is possible and such that flow of said first medium around said inlet porthole 3*a* or said inlet and outlet portholes 3*a*, 3*b* for said second medium is permitted during passage of said first medium between the inlet and outlet portholes 2*a*, 2*b* therefor.

In order to save space for heat exchange between the first and second media, each barrier 5 is at the illustrated embodiments of the plate 1 elongated, having a length which is many times larger than the width. At the illustrated embodiments of the plate 1, each barrier 5 also has the same height h1, i.e. a height which is also corresponding to or substantially corresponding to the height of the peripheral edges 3*aa*, 3*ba* of the inlet and outlet portholes 3*a*, 3*b* for the second medium on the first heat transferring surface A. However, the height of the barriers 5 of different plates 1 may vary, as may the height of said peripheral edges 3*aa*, 3*ba* on different plates.

Irrespective of whether the inlet and outlet portholes 3*a*, 3*b* for the second medium are located substantially centrally between the two long sides 1*a*, 1*b* of the plate 1 or closer to the long side opposing the long side closest to the inlet and outlet porthole respectively, for the first medium, it is preferred if said inlet and outlet portholes for the second medium are also located substantially centrally between the short side 1*c*, 1*d* closest thereto and the barrier 5 closest thereto, as in the illustrated embodiments. A uniform flow of the first medium around the portholes 3*a*, 3*b* for the second medium is thereby achieved.

At the illustrated embodiments of the plate according to the present invention, the second heat transferring surface B of the plate 1 is configured with at least one elevated portion 7 forming part of a restriction for the flow of the second medium during passage thereof between the inlet and outlet portholes 3*a*, 3*b* therefor. The elevated portion 7 is accordingly located between the inlet and outlet portholes 3*a*, 3*b* for the second medium. Thus, in the illustrated embodiments of the plate 1, the elevated portion 7 is located in a central part of the second heat transferring surface B, between depressions 5*a* corresponding to the barriers 5 on the first heat transferring surface A, to permit restriction and deflection of at least a part of the flow of the second medium when said flow of the second medium reaches said elevated portion during passage of said second medium between said inlet and outlet portholes 3*a*, 3*b* therefor. If desired, there may be more than one elevated portion 7 and each elevated portion may have any desired extension for its intended application or use. A substantial part of the flow of the second medium can by means of the elevated portion 7 as illustrated, be brought to flow to the sides of the second heat transferring surface and thereby prolong the flow distance and thus, the time it takes for the second medium to flow along the second heat transferring surface B between the inlet and outlet portholes 3*a*, 3*b* therefor. Each elevated portion 7 may on the opposite first heat transferring surface A of the plate 1 define a corresponding recessed portion 7*a*.

The first heat transferring surface A and the opposing second heat transferring surface B of the plate 1 are both configured with pressure-resisting, turbulence-generating dimples 9, and 11, 12 respectively. The dimples 9, 10, 11, 12 which may have any desired shape based on their intended application or use also take part in defining the height of the through-flow ducts X, Y for the first and second medium respectively. The dimples 9, on the first heat transferring surface A have a height which is larger than the height of the dimples 11, 12 on the opposing second heat transferring surface B, such that the volume of the through-flow duct X for the first medium will be larger than the volume of the through-flow duct Y for the second medium. The dimples 9 outside the depressed portion 7*a* of the first heat transferring surface A have the same or substantially the same height h1 as the barrier or barriers 5 or at least those parts of the barrier or barriers which according to the illustrated embodiments are not bounded by said depressed portion, and as the peripheral edges 3*aa*, 3*ba* of the inlet and outlet portholes 3*a*, 3*b* for the second medium on the first heat transferring surface A of the plate 1. The dimples in the depressed portion 7*a* of the first heat transferring surface A have a height h2 which is larger than the height h1 of the other dimples 9 outside said depressed portion. The height h2 of the dimples 10 in the depressed portion 7*a* of the first heat transferring surface A may also be equal or substantially equal to the height of those parts of the barrier or barriers 5 which according to the illustrated embodiments are bounded by said depressed portion, and is equal or substantially equal to the height of the dimples 9 plus the depth of said depressed portion. The depressed portion 7*a* defines a part of the through-flow duct X for the first medium which has a height 2*h*2) that is larger than the height 2*h*1) of said through-flow duct outside of said depressed portion. The dimples 11 on the elevated portion 7 of the second heat transferring surface B have a height h3 which is smaller than the height h4 of the other dimples 12 on said second heat transferring surface. The height of the elevated portion 7 and the height h3 of the dimples 11 on the elevated portion equals or substantially equals the height h4 of said other dimples 12 on said second heat transferring surface B. The height h4 of the dimples 12 outside the elevated portion 7 also equals or substantially equals the height of the peripheral edges 2*aa*, 2*ba* of the inlet and outlet portholes 2*a*, 2*b* for the first medium on the second heat transferring surface B of the plate 1. The elevated portion 7 defines a part of the through-flow duct Y for the second medium which has a height (2*h*3) that is smaller than the height (2*h*4) of said through-flow duct outside of said elevated portion to thereby provide a restriction for bringing a part of the flow of the second medium to flow to the sides of the second heat transferring surface B.

According to the invention, the plate 1 is configured with additional dimples 13 around the inlet and outlet portholes 3*a*, 3*b* for the second medium on the first heat transferring surface A of the plate. These dimples 13 are located at a larger distance from each other on those parts of the circumferences of the portholes 3*a*, 3*b* which face each other than those parts of said circumferences which face away from each other. As stated above, the configuration of the plate 1 with dimples 13 as defined and at the same time with the more spaced apart dimples located substantially away from the inlet and outlet portholes 2*a*, 2*b* for the first medium, the first medium will be able to further improve cooling of the second medium at the portholes for the second medium. This is achieved because the flow of the first medium thanks to the dimples 13 will experience a greater resistance at those parts of the circumference of the outlet porthole 3*b* for the second medium which are facing the inlet porthole 2*a* for the first medium, and a larger part of the first medium than otherwise will thereby be forced to flow further around said porthole for the second medium before it reaches said porthole for cooling thereof and for cooling the second medium flowing through said porthole. At the inlet porthole 3*a* for the second medium, the flow of the first medium will experience a less resistance and a larger part thereof than otherwise will therefore reach the circumference of said inlet porthole for the second medium much quicker for cooling thereof and for cooling the second medium flowing through said porthole before said first medium reaches its outlet porthole 2*b*. The dimples 13 around the inlet and outlet portholes 3*a*, 3*b* for the second medium on the first heat transferring surface A of the plate 1 may have a height which is equal or substantially equal to the height h1 of e.g. the dimples 9.

The above-mentioned arrangement of the dimples 13 around the inlet and outlet portholes 3*a*, 3*b* for the second medium on the first heat transferring surface A of the plate is particularly effective when the plate 1 is considered to be used in a heat exchanger of counterflow type. In a heat exchanger of the parallel-flow type, the arrangement of the dimples 13 may be the same.

The plate 1 is in a corresponding manner configured with additional dimples 14 around the inlet and outlet portholes 3*a*, 3*b* for the second medium on the second heat transferring surface B of the plate. These dimples 14 are located at a larger distance from each other on those parts of the circumferences of the portholes 3*a*, 3*b* which face away from each other than those parts of said circumferences which face each other. Optimum guiding of the second medium for cooling thereof will also be the result of that the plate 1 is configured with dimples 14 as defined and at the same time with the more spaced apart dimples located such that they at least partly face the inlet and outlet portholes 2*a*, 2*b* for the first medium, because the second medium experiences thereby a less restricted flow towards said inlet and outlet portholes for the first medium for cooling thereby the entire way of the flow of said first medium from the inlet porthole to the outlet porthole therefor. The dimples 14 around the inlet and outlet portholes 3*a*, 3*b* for the second medium on the second heat transferring surface B of the plate 1 may have a height which is equal or substantially equal to the height h4 of e.g. the dimples 12.

All dimples 9, 10, 11, 12, 13 and 14 have corresponding depressions 9*a*, 10*a*, 11*a*, 12*a*, 13*a* and 14*a* on the opposite side of the plate 1.

Finally, each plate 1 may also be configured with at least one, in the illustrated embodiments two portholes 15*a* and 15*b*. These relatively small portholes 15*a*, 15*b*, which in the illustrated embodiments are located in the corners opposite to the inlet and outlet portholes 2*a*, 2*b* for the first medium, on the other side of the respective inlet and outlet portholes

3*a*, 3*b* for the second medium, are on the first heat transferring surface A surrounded by a peripheral edge 15*aa* and 15*ba* respectively, for preventing the first medium from entering into said portholes. On the other hand, the portholes 15*a*, 15*b* are on the second heat transferring surface B configured such that they can communicate with the through-flow duct Y for the second medium defined between the second heat transferring surfaces of two adjacent plates 1. Second medium which during its passage through the through-flow duct Y therefor has been cooled by the first medium such that it has condensed and deposited on the second heat transferring surfaces B, can thereby flow to the portholes 15*a*, 15*b* and exit the heat exchanger through said portholes 15*a*, 15*b* by proper positioning of the heat exchanger.

As mentioned above, the present invention also relates to a heat exchanger for heat exchange between a first and a second medium. The heat exchanger thereby comprises a stack of plates 1 of the above-mentioned configuration. The stack of plates 1 may be located in a more or less open framework and pipe connections for the first and second media are also provided. The number of plates 1 in the stack may vary and so may the size of the heat exchanger, depending on its intended application or use.

As already indicated above, the plates 1 in the stack thereof in the heat exchanger are arranged such that the first heat transferring surface A for the first medium (e.g. water for cooling the second medium) of each plate is abutting the first heat transferring surface A of an adjacent plate in the stack (see FIGS. 10*a* and 10*c*), thereby defining, by means of the opposing barrier or barriers 5, the substantially U-shaped or sinusoidal through-flow duct X for the first medium between said first heat transferring surfaces of said plates. Opposing dimples 9, 10 and 13, opposing peripheral edges 3*aa*, 3*ba* around the inlet and outlet portholes 3*a*, 3*b* for the second medium and, to some extent, opposing peripheral edges 15*aa*, 15*ba* around the portholes 15*a*, 15*b* for removal of condensed second medium of course also contribute in defining the through-flow duct X for the first medium, but the shape thereof as defined is determined by the barrier or barriers 5. Thus, in operation of the heat exchanger comprising a stack of the above-mentioned plates 1, the first medium may pass, in a heat exchanger of the counter-flow type, around two opposing outlet portholes 3*b* for the second medium before it can pass the guide or guides defined by the opposing barriers 5 on the heat transferring surfaces A for the first medium of two adjacent plates 1 and, after having passed the guide or guides, the first medium has to pass two additional opposing inlet portholes 3*a* for the second medium before it can leave the through-flow duct X therefor. In a heat exchanger of the parallel-flow type, the first medium has to pass around two opposing inlet portholes 3*a* for the second medium before it can pass the guide or guides defined by the opposing barriers 5 on the heat transferring surfaces A for the first medium of two adjacent plates 1 and, after having passed the guide or guides, the first medium may pass two additional opposing outlet portholes 3*b* for the second medium before it leaves the through-flow duct X therefor.

Furthermore, the plates 1 are stacked such that the second heat transferring surface B for the second medium (e.g. air to be cooled by the water) of each plate is abutting the second heat transferring surface B of an adjacent plate in the stack, thereby defining the through-flow duct Y for the second medium between said second heat transferring surfaces of said plates (see FIGS. 10*b* and 10*c*). Opposing dimples 11, 12 and 14 and opposing peripheral edges 2*aa*, 2*ba* around the inlet and outlet portholes 2*a*, 2*b* for the first medium of course contribute in defining the through-flow duct Y for the second medium.

The second medium flows along its through-flow duct Y preferably in a cross flow relative to the first medium, i.e. the heat exchanger according to the present invention is preferably of the cross-flow type, wherein straight, parallel or substantially parallel portions of the substantially U-shaped or sinusoidal through-flow duct X for the first medium defined between the first heat transferring surfaces A of two adjacent plates in the stack extend in a first direction D1 of the plates, in the illustrated embodiments perpendicular or substantially perpendicular to the longitudinal direction of the plates, and wherein the through-flow duct Y for the second medium defined between the second heat transferring surfaces B of two adjacent plates in the stack extends in a second direction D2 of the plates which is perpendicular or substantially perpendicular to said first direction, in the illustrated embodiments in or substantially in the longitudinal direction of the plates. In FIGS. 10*a-c*, the through-flow duct X for the first medium extends in a first direction D1 perpendicular to the plane defined by the drawing paper and the through-flow duct Y for the second medium extends in the plane defined by the drawing paper. Also, as indicated above, the second medium enters its through-flow duct through the inlet porthole 3*a* therefor and leaves the through-flow duct through its outlet porthole 3*b*, i.e. flows in the illustrated embodiments of the plate 1 in the opposite direction relative to the flow of the first medium between the inlet and outlet portholes 2*a*, 2*b* therefor. However, the heat exchanger according to the present invention may alternatively, which is also indicated above, be of another type than said cross-flow/counter-flow type, e.g. of a parallel-flow type such that when the second medium enters its through-flow duct through the inlet porthole 3*a* therefor and leaves the through-flow duct through its outlet porthole 3*b*, then it flows in the same direction as the flow of the first medium between the inlet and outlet portholes 2*a*, 2*b* therefor. It is nevertheless important that cooling is performed if not of both portholes 3*a*, 3*b* for the second medium and the second medium flowing through said portholes, so at least of the inlet porthole for said second medium and of the second medium entering the heat exchanger through said inlet porthole.

The plates 1 are also stacked such that a peripheral flange on one of two adjacent plates which first or second heat transferring surfaces A or B face each other, surrounds the through-flow duct X or Y defined between said heat transferring surfaces. This peripheral flange may, as indicated above, be the peripheral flange 4. The peripheral flange 4 may protrude from the plate 1 such that it surrounds both of the first heat transferring surface A for the first medium and the second heat transferring surface B for the second medium of said plate. Then, only every second plate in the stack thereof needs to be configured with a peripheral flange. Alternatively, the peripheral flange 4 may protrude from every second plate 1 such that it surrounds only the second heat transferring surface B for the second medium (see FIGS. 1-4 and 10*a-c*) and protrude from every second plate such that it surrounds only the first heat transferring surface A for the first medium (see FIGS. 5-8, 9*a-b* and 10*a-c*). Then, each plate 1 in the stack thereof needs to be configured with a peripheral flange.

In order to provide a sufficiently leak-free and safe, pressure-resisting heat exchanger, the first heat transferring surfaces A for the first medium of two adjacent plates 1 in the stack are properly assembled at the opposing barrier or barriers 5, at the opposing dimples 9, 10, 13 and at the opposing peripheral edges 3*aa*, 3*ba* surrounding the inlet and outlet portholes 3*a*, 3*b* for the second medium and the second heat transferring surfaces B for the second medium of two adjacent plates 1 in the stack are properly assembled at the opposing dimples 11, 12, 14 and at the opposing peripheral edges 2*aa*, 2*ba* surrounding the inlet and outlet portholes 2*a*, 2*b* for the first medium.

For providing a sufficiently leak-free flow of the first and second media through their respective through-flow duct X and Y respectively, the peripheral flanges 4 which surround the plates 1 need also be properly assembled with adjacent plates or with other peripheral flanges.

While the present invention has been illustrated by the description of the preferred embodiments thereof, and while these embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods and illustrative examples shown and described. Accordingly, departures may be made from such details without departure from the scope of applicant's general inventive concept. Further, it is to be appreciated that improvements and/or modifications may be made without departing from the scope of the present invention as defined by the following claims. Thus, specifically, although the plate 1 is made of stainless steel, it can also be made of any other suitable material. The stack of plates in the heat exchanger can be located in a framework of any suitable material. The heat exchanger can in its intended application be located in any suitable position, i.e. horizontally or vertically or obliquely if that is required or desired. A heat exchanger as defined is suitable for use as an air cooler, since the second medium, the medium to be cooled, may be air.

The invention claimed is:

1. A plate for a heat exchanger for heat exchange between a first and a second medium, wherein the plate (1) has a rectangular shape with two opposing long sides (1*a* and 1*b*) and two opposing short sides (1*c* and 1*d*), wherein the plate (1) is configured with at least one inlet porthole (2*a*) and at least one outlet porthole (2*b*) for the first medium and at least one inlet porthole (3*a*) and at least one outlet porthole (3*b*) for the second medium, wherein the plate (1) is configured with the inlet porthole (2*a*) for the first medium located in or close to a corner between one of the two long sides (1*a* or 1*b*) and one of the two short sides (1*c* or 1*d*) and the outlet porthole (2*b*) for the first medium located in or close to a corner between the same or the other long side (1*a* or 1*b*) and the other of said two short sides (1*d* or 1*c*), wherein the plate (1) is configured with the inlet porthole (3*a*) for the second medium located centrally between the two long sides (1*a*, 1*b*) and close to one of the two short sides (1*c* or 1*d*) and the outlet porthole (3*b*) for the second medium located centrally between the two long sides (1*a*, 1*b*) and close to the other of said two short sides (1*d* or 1*c*), wherein the plate (1) has a first heat transferring surface (A) for the first medium and an opposing second heat transferring surface (B) for the second medium, wherein the first heat transferring surface (A) of said plate (1) is configured with at least one barrier (5) forming part of a guide for the flow of the first medium during passage thereof between said inlet and outlet portholes (2*a* and 2*b*) therefor;

wherein the plate (1) is configured with the inlet and outlet portholes (2*a*, 2*b* and 3*a*, 3*b*) for the first and second medium respectively, and with the at least one barrier (5) forming part of a guide for the flow of said first medium on the first heat transferring surface (A) of the plate, the at least one barrier forming a substantially U-shaped or sinusoidal through-flow duct (X) for the first medium which will permit passage of the flow of said first medium around said inlet porthole (3*a*) or said inlet and outlet portholes (3*a* and 3*b*) for said second medium during passage of said first medium between said inlet and outlet portholes (2*a*, 2*b*) therefor, wherein the plate (1) is configured with first adjacent dimples (13) around the inlet and outlet portholes (3*a*, 3*b*) for the second medium on the first heat transferring surface (A) of the plate located at a larger distance from each other on those parts of the circumferences of the portholes which face each other than on those parts which face away from each other, wherein the plate (1) is configured with second adjacent dimples (14) around the inlet and outlet portholes (3*a*, 3*b*) for the second medium on the second heat transferring surface (B) of the plate located at a larger distance from each other on those parts of the circumferences of the portholes which face away from each other than on those parts which face each other, wherein the inlet and outlet portholes for the second medium are provided with an inner peripheral edge, wherein the plate comprises a flow-path for the first medium surrounding the inlet and outlet portholes for the second medium on the first heat transferring surface of the plate, and wherein the flow path is bounded by on one hand the inner peripheral edge and on the other hand the first adjacent dimples around the inlet and outlet portholes for the second medium on the first heat transferring surface of the plate.

2. The plate according to claim 1, wherein the plate (1) is configured with the inlet porthole (2*a*) for the first medium located in or close to a corner between one of the two long sides (1*a* or 1*b*) and one of the two short sides (1*c* or 1*d*) and the outlet porthole (2*b*) for the first medium located in or dose to a corner between the same long side (1*a* or 1*b*) and the other of said two short sides (1*d* or 1*c*), wherein the plate (1) is configured with the inlet porthole (3*a*) for the second medium located centrally between the two long sides (1*a*, 1*b*) and close to one of the two short sides (1*c* or 1*d*) and the outlet porthole (3*b*) for the second medium located centrally between the two long sides (1*a*, 1*b*) and close to the other of said two short sides (1*d* or 1*c*), wherein the plate (1) is configured with an uneven number of barriers (5) provided on the first heat transferring surface (A) of the plate, and wherein the barrier or barriers (5) closest to the inlet and outlet portholes (2*a*, 2*b*) for the first medium is/are configured to extend from the long side (1*a* or 1*b*) closest to said portholes and towards the opposing long side (1*b* or 1*a*) to form part of one or more guides for guiding the flow of said first medium along a substantially U-shaped or sinusoidal through-flow duct (X).

3. The plate according to claim 2, wherein a barrier (5) between the two barriers which are located closest to the inlet and outlet portholes for the first medium is configured to extend from the long side (1*b* or 1*a*) opposite to the long side (1*a* or 1*b*) from which the barriers (5) closest to said inlet and outlet portholes (2*a*, 2*b*) for the first medium extend and towards the opposing long side (1*a* or 1*b*) to form part of a guide for guiding the flow of said first medium along a substantially sinusoidal through-flow duct (X).

4. The plate according to claim 3, wherein said additional barrier or barriers (5) is/are configured to permit leakage of a part of the flow of the first medium between said barrier or barriers and said respective long side.

5. The plate according to claim 2, wherein the plate (1) is configured with at least two additional barriers (5) between two barriers (5) which are located closest to the inlet and outlet portholes (2*a*, 2*b*) for the first medium, and wherein said additional barriers (5) are configured to extend alternately from one of the two long sides 1*a* or 1*b*) and towards the opposing long side (1*b* or 1*a*) to form part of guides for guiding the flow of said first medium along a substantially sinusoidal through-flow duct (X).

6. The plate according to claim 1, wherein the plate (1) is configured with the inlet porthole (2*a*) for the first medium located in or close to a corner between one of the two long sides (1*a* or 1*b*) and one of the two short sides (1*c* or 1*d*) and the outlet porthole (2*b*) for the first medium located in or close to a corner between the other of said two long sides (1*b* or 1*a*) and the other of said two short sides (1*d* or 1*c*), wherein the plate (1) is configured with the inlet porthole (3*a*) for the second medium located centrally between the two long sides (1*a*, 1*b*) and dose to one of the two short sides (1*c* or 1*d*) and the outlet porthole (3*b*) for the second medium located centrally between the two long sides (1*a*, 1*b*) and close to the other of said two short sides (1*d* or 1*c*), wherein the plate (1) is configured with an even number of barriers (5) provided on the first heat transferring surface (A) of the plate, and wherein the barriers (5) closest to the inlet and outlet portholes (2*a*, 2*b*) for the first medium are configured to extend from the long side (1*a* or 1*b*) closest to the respective porthole and towards the opposing long side (1*b* or 1*a*) to form part of guides for guiding the flow of said first medium along a substantially U-shaped sinusoidal through-flow duct (X).

7. The plate according to claim 1, wherein each barrier (5) has a same height (h1).

8. The plate according to claim 1, wherein the second heat transferring surface (B) of the plate (1) is configured with at least one elevated portion (7) forming part of a restriction for the flow of the second medium during passage thereof between said inlet and outlet portholes (3*a*, 3*b*) therefor.

9. The plate according to claim 8, wherein the plate (1) is configured with the elevated portion (7) located between the inlet and outlet portholes (3*a*, 3*b*) for the second medium on the second heat transferring surface (B) of the plate to permit restriction and deflection of at least a part of the flow of the second medium when said flow of the second medium reaches said elevated portion during passage of said second medium between said inlet and outlet portholes therefor.

10. The plate according to claim 1, wherein the first heat transferring surface (A) and the opposing second heat transferring surface (B) of the plate (1) are both configured with dimples (9, 10 and 11, 12 respectively) which will define a height of the through-flow ducts (X, Y) for the first and second medium respectively, and wherein the dimples (9, 10) on the first heat transferring surface (A) have a height (h1, h2) which is larger than the height (h3, h4) of the dimples (11, 12) on the opposing second heat transferring surface (B).

11. The plate according to claim 10, wherein the first heat transferring surface (A) of the plate (1) is configured with at least one depressed portion (7*a*) corresponding to or substantially corresponding to an elevated portion (7) on the second heat transferring surface (B) of the plate, and wherein the dimples (10) in the depressed portion (7*a*) have a height (h2) which is larger than a height (h1) of the other dimples (9) on the first heat transferring surface (A).

12. The plate according to claim 10, wherein the dimples (9) outside a depressed portion (7*a*) of the first heat transferring surface (A) of the plate (1) have the same or substantially the same height (h1) as the barrier or barriers (5).

13. The plate according to claim 10, wherein the dimples (11) on an elevated portion (7) of the second heat transferring surface (B) of the plate (1) have a height (h3) which is smaller than a height (h4) of the other dimples (12) on the second heat transferring surface (B).

14. The plate according to claim 1, wherein the inlet and outlet portholes (2*a*, 2*b*) for the first medium are configured with a peripheral edge (2*aa* and 2*ba*) on the second heat transferring surface of the plate, and wherein the inlet and outlet portholes (3*a*, 3*b*) for the second medium are configured with a peripheral edge (3*aa* and 3*ba*) on the first heat transferring surface of the plate.

15. The plate according to claim 14, wherein the peripheral edges (2*aa*, 2*ba*) of the inlet and outlet portholes (2*a*, 2*b*) for the first medium on the second heat transferring surface (B) of the plate (1) have the same or substantially a same height (h2) as dimples (11) on the second heat transferring surface (B) outside an elevated portion (7) thereof, and wherein the peripheral edges (3*aa*, 3*ba*) of the inlet and outlet portholes (3*a*, 3*b*) for the second medium on the first heat transferring surface (A) of the plate (1) have the same or substantially a same height (h1) as the barrier or barriers (5) and the dimples (9) on the first heat transferring surface (A).

16. The plate according to claim 1, wherein the plate (1) is configured with a peripheral flange (4) which protrudes from the plate such that it surrounds either or both of the first heat transferring surface (A) for the first medium and the second heat transferring surface (B) for the second medium.

17. The plate according to claim 1, wherein the plate (1) is configured with at least one porthole (15*a* and/or 15*b*) for permitting removal of the second medium.

18. A heat exchanger for heat exchange between a first and a second medium, wherein the heat exchanger comprises a stack of plates (1) according to claim 1, wherein said plates (1) are stacked such that the first heat transferring surfaces (A) for the first medium of two adjacent plates (1) face each other and the second heat transferring surfaces (B) for the second medium of two adjacent plates face each other, thereby defining, by means of the at least one barrier (5) on the first heat transferring surfaces (A) of two adjacent plates, a substantially U-shaped or sinusoidal through-flow duct (X) for the first medium between said first heat transferring surfaces (A) therefor as well as a through-flow duct (Y) for the second medium between the second heat transferring surfaces (B) therefor, and such that a peripheral flange (4) on one of two adjacent plates (1), the first or second heat transferring surfaces (A or B) of which face each other, surrounds the through flow duct (X or Y) defined between said heat transferring surfaces.

19. The heat exchanger according to claim 18, wherein the first heat transferring surfaces (A) for the first medium of two adjacent plates (1) in the stack are assembled at the opposing barrier or barriers (5) and at opposing dimples (9, 10) as well as at opposing edges (3*aa*, 3*ba*) surrounding the inlet and outlet port-holes (3*a*, 3*b*) for the second medium in said first heat transferring surfaces (A).

20. The heat exchanger according to claim 18, wherein the second heat transferring surfaces (B) for the second medium of two adjacent plates (1) in the stack are assembled at opposing dimples (11, 12) and at opposing edges (2*aa*, 2*ba*) surrounding the inlet and outlet portholes (2*a*, 2*b*) for the first medium in said second heat transferring surfaces (8).

21. The heat exchanger according to claim 18, wherein straight, parallel or substantially parallel portions of the substantially U-shaped or sinusoidal through-flow ducts (X) for the first medium defined between the first heat transferring surfaces (A) of two adjacent plates (1) in the stack extend in a first direction (D1) of the plates, and wherein the through-flow duct (Y) for the second medium defined between the second heat transferring surfaces (B) of two adjacent plates (1) in the stack extends in a second direction (D2) of the plates which is perpendicular or substantially perpendicular to said first direction (D1).

22. An air cooler comprising a heat exchanger according claim 18, wherein the first medium is a liquid and the second medium is air.

23. The plate according to claim 1, wherein the flow-path provides an uninterrupted flow of the first medium around the inlet and outlet portholes for the first medium on the first heat transferring surface of the plate.

24. The plate according to claim 1, wherein the outer side of the flow-path is further surrounded by the second adjacent dimples around the inlet and outlet portholes for the second medium on the second heat transferring surface of the plate.

25. The plate according to claim 1, wherein the outer side of the flow-path is bound by the first adjacent dimples around the inlet and outlet portholes for the second medium on the first heat transferring surface of the plate and/or the dimples around the inlet and outlet portholes for the second medium on the second heat transferring surface of the plate.

26. The plate according to claim 1, wherein the inner peripheral edge completely surrounds the inlet and outlet portholes for the second medium.

27. The plate according to claim 1, wherein the flow path extends around the entire inlet and outlet portholes for the second medium and/or the inner peripheral edge.

28. The plate according to claim 1, wherein all the first adjacent dimples around the inlet porthole for the second medium on the first heat transferring surface of the plate are equally spaced from the inner peripheral edge of the inlet porthole for the second medium.

29. The plate according to claim 1, wherein all the first adjacent dimples around the outlet porthole for the second medium on the first heat transferring surface of the plate are equally spaced from the inner peripheral edge of the outlet porthole for the second medium.

* * * * *